United States Patent [19]

Buxton

[11] Patent Number: 4,807,877

[45] Date of Patent: Feb. 28, 1989

[54] ROTARY WEIGHT LIFTING MACHINE

[76] Inventor: Brian F. Buxton, 57 Auburn Rd., West Hartford, Conn. 06112

[21] Appl. No.: 4,075

[22] Filed: Jan. 16, 1987

[51] Int. Cl.[4] ..... A63B 21/00

[52] U.S. Cl. ..... 272/130; 272/116; 272/128

[58] Field of Search ..... 272/71, 73.2, 116, 128, 272/130, 134, 146

[56] References Cited

U.S. PATENT DOCUMENTS

| | | | |
|---|---|---|---|
| 1,279,633 | 9/1918 | Allen | 272/116 |
| 4,082,264 | 4/1978 | Santos | 272/130 X |
| 4,249,725 | 2/1981 | Mattox | 272/128 X |
| 4,627,613 | 12/1986 | Saloway | 272/116 |
| 4,673,180 | 6/1987 | Rice | 272/146 |

FOREIGN PATENT DOCUMENTS

| | | | |
|---|---|---|---|
| 2631477 | 1/1978 | Fed. Rep. of Germany | 272/146 |

*Primary Examiner*—Richard J. Apley
*Assistant Examiner*—Robert D. Bahr
*Attorney, Agent, or Firm*—Hayes & Reinsmith

[57] ABSTRACT

The present invention provides an exercise device comprising a frame; a rotatable axle on the frame; a crank for rotating the axle; and a counterforce assembly wheel connected to the axle for producing a static counterforce to rotation of the axle. The counterweight assembly includes a tank for reservoir and valves for varying the predetermined fluid level in the tank, and counterforce assembly wheel drivingly connected to the axle and rotatable about a non-vertical axis. The wheels have a plurality of troughs spaced uniformly around the axis. The troughs are positioned to pass through the tank as the wheel is rotatably driven by the crank, receive at least a portion of fluid in the tank, carry the received fluid above the predetermined fluid level and discharge the received fluid at a position above the predetermined fluid level.

19 Claims, 4 Drawing Sheets

ROTARY WEIGHT LIFTING MACHINE

BACKGROUND OF THE INVENTION

The present invention relates to an exercise device, and, in particular, to an improved exercise device utilizing fluids to provide a static counterforce for exercising opposing muscle groups.

In exercising it is desirable to provide a uniform exercise over opposing muscle groups in any one portion of the body. These opposing muscle groups are those which are respectively utilized to exert forces in opposing directions, for example, by exerting a force away from the body then exerting an equal and opposite force back towards the body.

The various exercise devices generally utilizing cranks to engage the arms or legs have been developed to exercise these opposing muscle groups. These exercise devices generally rely on frictional or resistance forces developed by rotating the crank mechanism. Since the resistence force is dynamically produced, it generally varies considerably with the angular velocity of the crank mechanism.

Free weights and those devices utilizing such weights are useful in exercise because they provide a uniform static force when lifted against the force of gravity. However, free weight and other weight lifting devices are generally not useful for exercising opposing muscle groups because they do not provide an equal return force to lower the weight after lifting. Separate exercises then have to be devised to exercise these opposing muscle groups which result in great ineffeciency and extra expended exercise time.

Bearing in mind these and other deficiencies of the prior art it is therefor a primary object of the present invention to provide an improved device which exercises opposing muscle groups.

It is another object of the present invention to provide an exercise device which provides a static resistance force component which is independent of exercise speed.

It is a further object of the present invention to provide an exercise device which provides for a continuous useful exercise against a counter resistence.

It is yet another object of the present invention to provide an improved apparatus to effect controlled exercise of opposing muscle groups.

It is a further object of the present invention to provide an exercise device which combines the feedback of free weight lifting with the continuous action of rotary motion.

Other objects will be in part obvious and in part pointed out in more detail hereinafter.

A better understanding of the objects, advantages, features, properties and relations of the invention will be obtained from the following detailed description and accompanying drawings which set forth an illustrative embodiment and is indicative of the way in which the principle of the invention is employed.

SUMMARY OF THE INVENTION

The present invention provides an exercise device comprising a frame; a rotatable axle on the frame; a body-engaging means for rotating the axle; and a counterweight assembly connected to the axle for producing a static counterforce to rotation of the axle. The counterweight assembly includes a tank for holding a fluid at a predetermined level, means for varying the predetermined fluid level in the tank, and at least one wheel drivingly connected to the axle and rotable about a non vertical axis, the wheel having a plurality of troughs spaced uniformly around the axis, the troughs being positioned to pass through the thank as the wheel is rotatably driven by the body engaging means, receive at least a portion of fluid in the tank, carry the received fluid above the predetermined fluid level and discharge the received fluid at a position above the predetermined fluid level.

In its preferred embodiment, the present invention utilizes a plurality of counterforce assembly wheels, each rotating through a liquid and having progressively varying trough liquid volumes about the peripheries thereof, and means for adjusting the desired relative angular orientation of the wheels, for varying the maximum and minimum static counterforce as the wheels are rotated through one revolution.

DETAILED DESCRIPTION OF THE INVENTION

Figure 1:
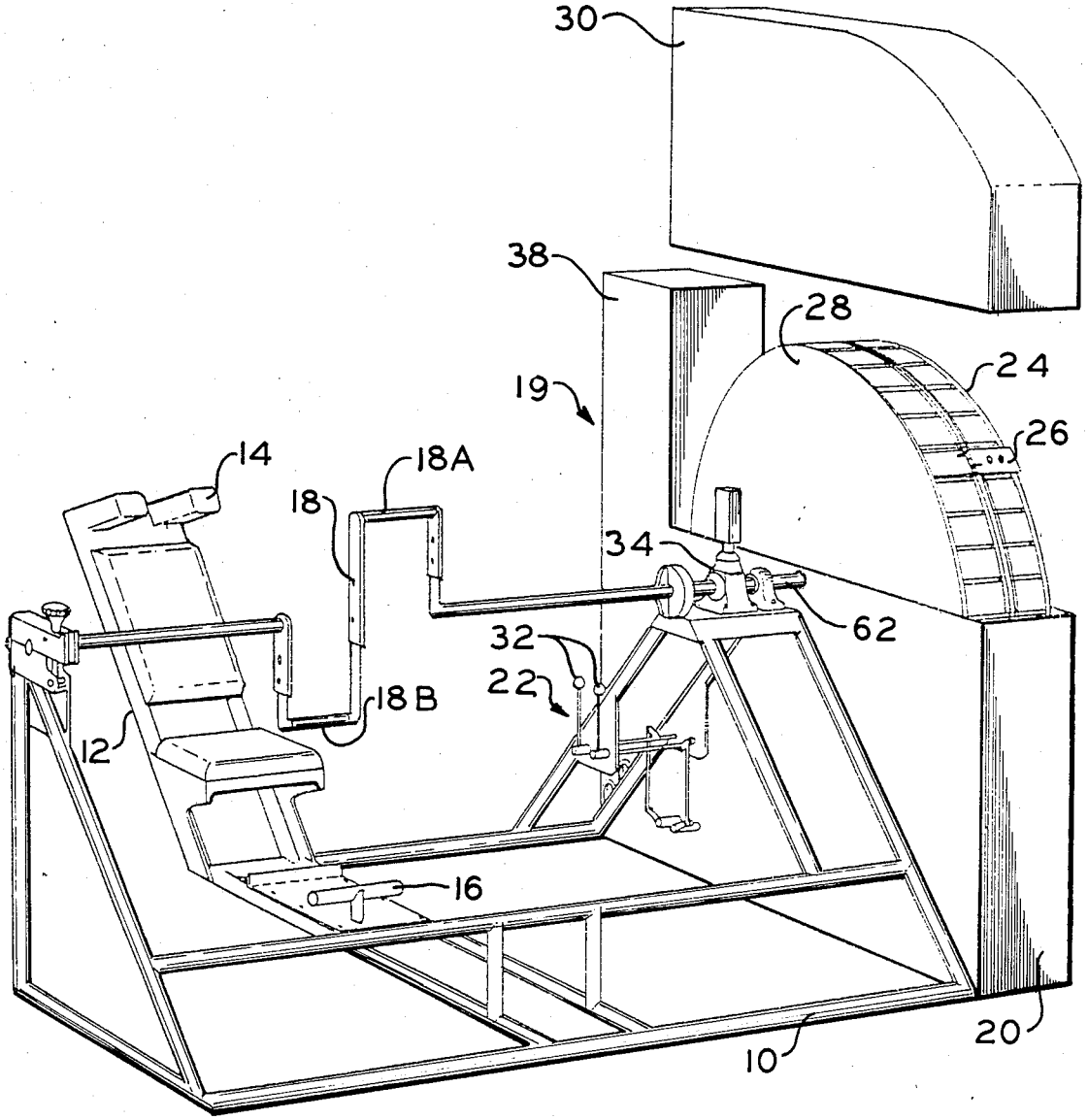
FIG. 1 is a perspective view of the preferred embodiment of the exercise device of the present invention.

The preferred embodiment of the exercise device of the present invention is shown in FIG. 1. An adjustable seat 12 is mounted on frame 10 and includes shoulder restraints 14 and foot anchors 16. A rotatable axle is mounted to be rotated by body-engaging means, here shown as crank 18. Crank 18 is mounted on frame 10 relative to adjustable seat 12 so that crank 18 may be engaged and turned by either the arms or the legs of a person sitting in seat 12. Rotary motion from crank 18, here shown as a double throw **18*a*, 18*b* crank, is transmitted through axle 17 and gear box 34 to counterweight assembly 19 which produces a static counterforce to rotation of the crank mechanism 18. If desired, a single throw crank or other mechanisms, such as a rack and pinion assembly or a ratchet assembly, may be substituted. Gear box 34 may include a transmission to select forward to reverse rotation of counterweight assembly 19** without need to reposition or reverse the direction of a single throw crank.

Counterweight assembly 19 includes wheel assemblies 24, 28 which rotate along axis 62 through a fluid carrying tank 20. Although the embodiment shown herein employs a liquid as the fluid, other substances having liquid-like properties, such as a finely divided solid, may be employed. Wheel assemblies 24 and 28 are fixed in a desired relative angular orientation by spring loaded hasp 26 which secures the two wheel assemblies in a desired orientation. A liquid reservoir 38 communicates with tank 20 by liquid level adjustment means 22 which is here shown including actuating valve handles 32 for adjusting the level of liquid in tank 20. The preferred liquid is water. A cover 30 is provided for the top of tank 20 to prevent liquid therein from splashing outside due to the rotation of wheel assemblies 24 and 26.

Figure 2:
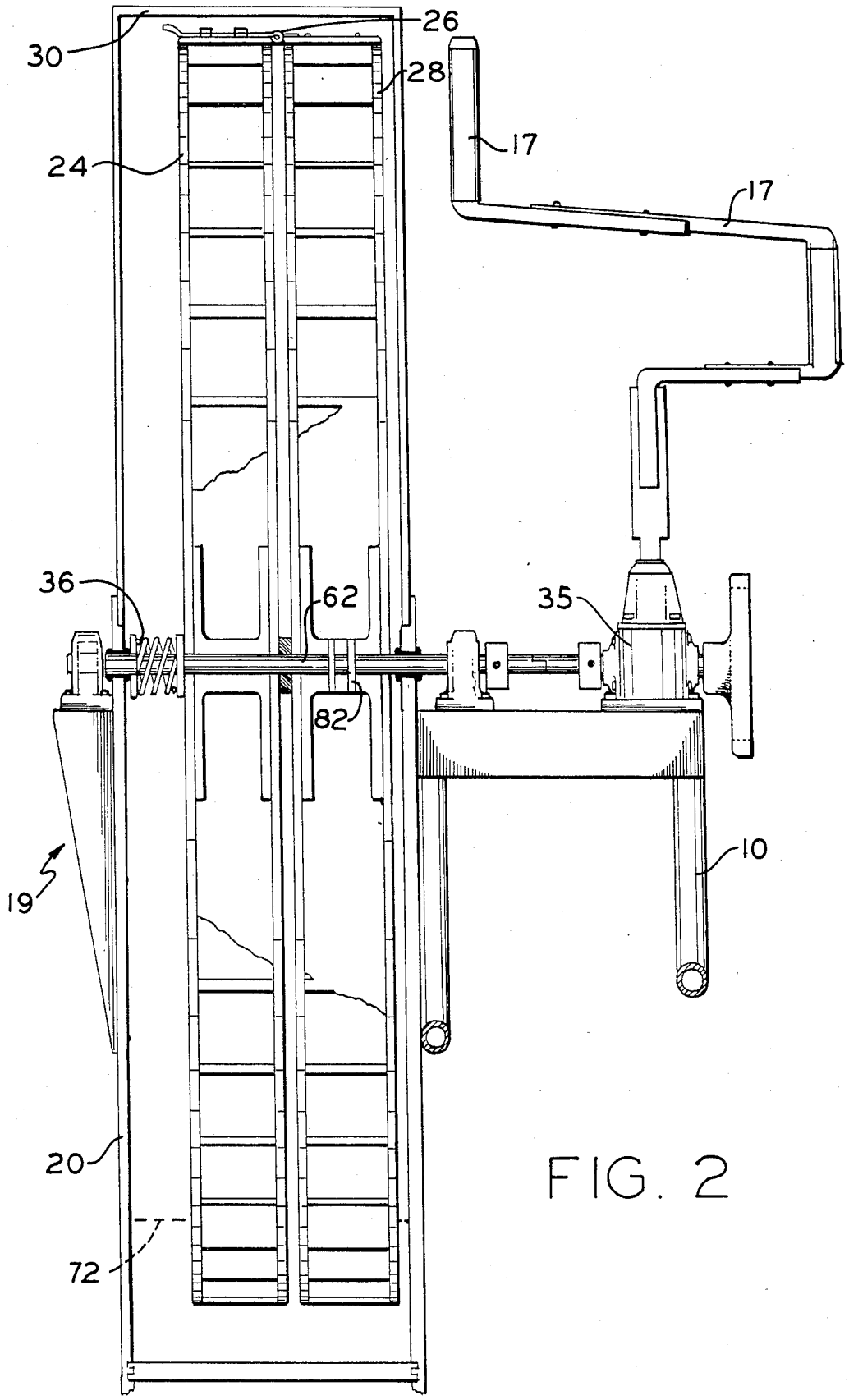
FIG. 2 is a cross-section of a modification of the embodiment of FIG. 1.

FIG. 2 illustrates the counterweight assembly 19 in a longitudinal cross-section through axis 62. FIG. 2 also includes an alternate embodiment of the crank mechanism, shown here as a vertically oriented double throw crank 17 which through gear box 35 rotatably drives the wheel assemblies 24 and 28 around axis 62. Axial compression spring 36 between the wall of tank 20 and wheel 24 holds wheel assemblies 24 and 28 together along axis 62. Pins 82 secure wheel assembly 28 on axis 62 while hasp assembly 26 secures wheel assembly 24 to assembly 28 in a desired orientation.

Figure 4:
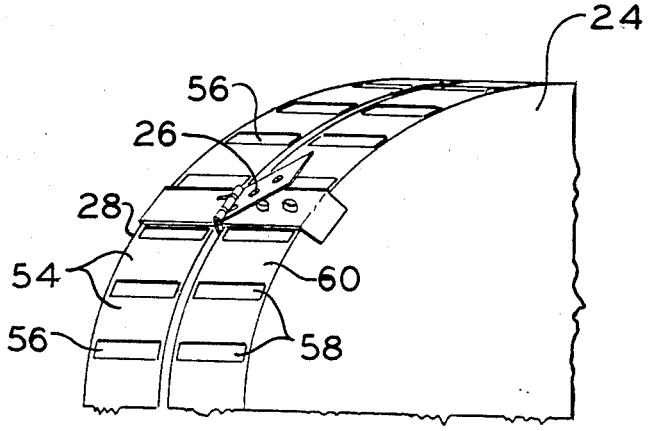
FIG. 4 illustrates detail in the static counterforce assembly of the embodiment in FIG. 1.
Figure 3:
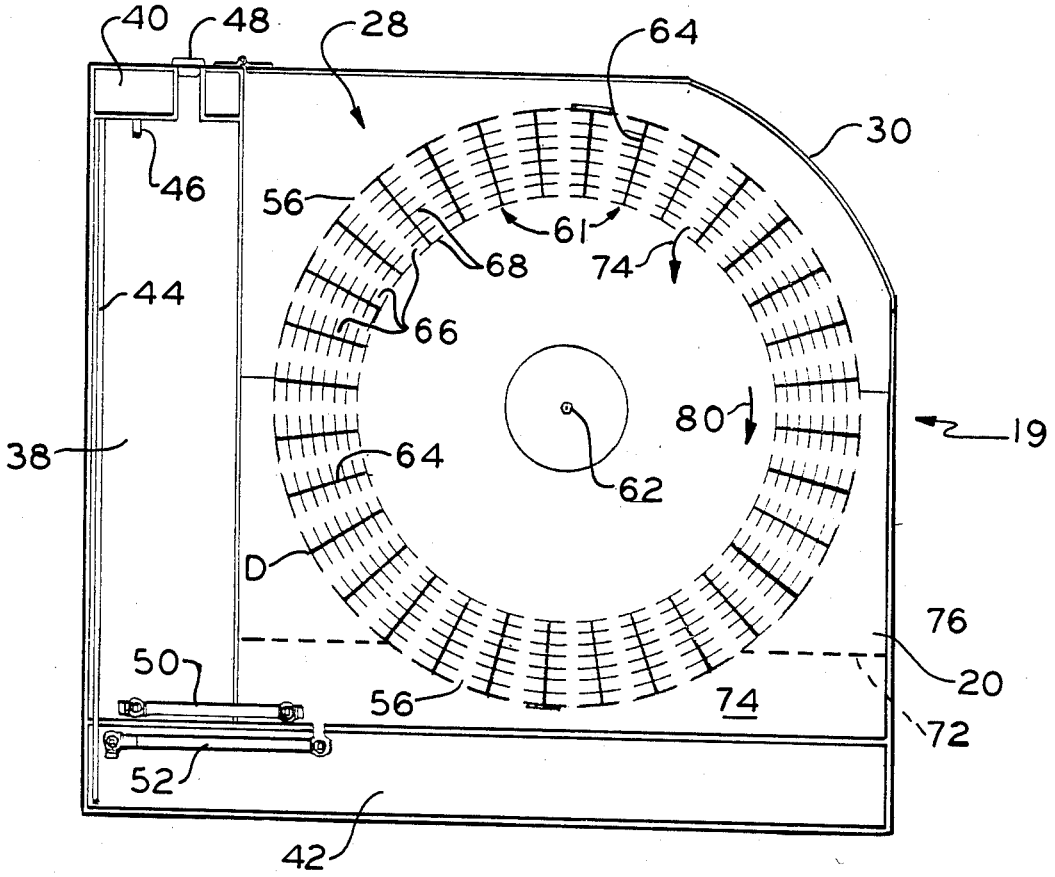
FIG. 3 is a cross-section of the static counterforce assembly of the preferred embodiments in FIG. 1.
Figure 5:
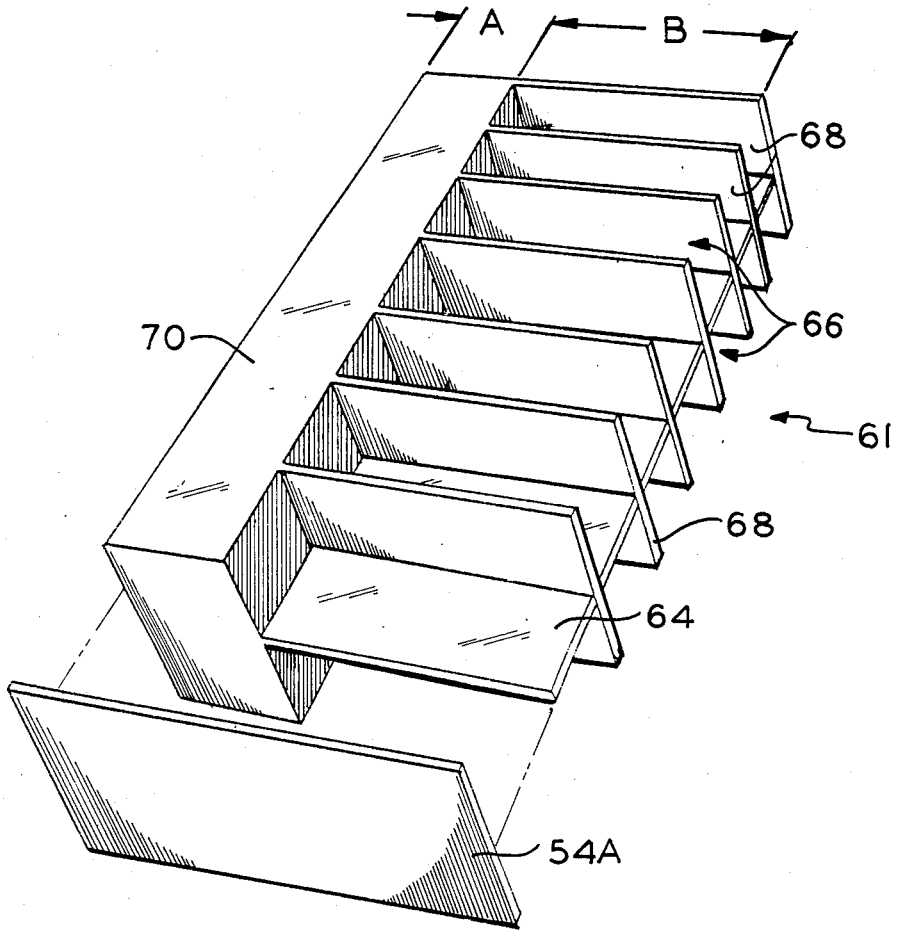
FIG. 5 is a perspective view of the trough assembly.

In FIG. 3, counterweight assembly 19 is shown in a radial cross-section through wheel assembly 28. Tank 20 is shown holding a liquid 74 at a pre-determined level 72 through which wheel assembly 28 rotates in the direction shown by arrow 76. Tank 20 is shown connected by valve means 52 to drop tank 42 for receiving excess liquid 74 when it is desired to lower the liquid level 72 in tank 20. Reservoir 38 holds liquid which may be released via a valve means 50 to fill tank 20. Both valve means 50 and 52 may include means to control the rate of flow of liquid between reservoir 38, tank 20, and dump tank 42. A fill pipe 48 at the top of assembly 19 allows reservoir 38 to be filled. Pump 40 draws liquid from dump tank 42 and deposits it through exit orifice 46 to replenish the supply of fluid in reservoir 38. As seen in FIGS. 3, 4, and 5, the wheel assembly 28 includes a plurality of trough assemblies 61 spaced uniformly around the periphery of the wheel assembly and axis 62. As used herein, the term "trough" includes any suitable bucket or container for receiving and carrying a fluid from the tank 20.

Each trough assembly 61 includes a radially extending member or plate 64 which extends from one side wall of the wheel assembly to the other. A series of plates 68 extend perpendicularly from radial plate 64 on either side and form a series of individual troughs 66 which are spaced at different radial distances from axis 62. These plates 68 also control wave motion of the liquid in the tank 20 as the wheel assemblies 24, 28 are rotated, thereby controlling and reducing splash out. A plate **54*a* is joined to the outer-most end of radial plate 64 and forms the peripheral wall 54 of wheel assembly 28. Trough assemblies 61 are spaced uniformly about the circumference of wheel assembly 28. Openings 56, 58 on wheel assemblies 28 and 24 respectively are formed between end plates 54*a* to allow liquid to enter the individual troughs. The troughs formed on each side of individual radial plates 64 permit trough assemblies 61 to receive liquid regardless of direction of wheel rotation. This allows counterforce assembly 19** to operate in either rotational direction.

As shown in FIG. 3 wheel assembly 28 rotates in tank 20 in direction 76 so that a lower portion of the wheel assembly 28 passes below liquid level 72. As the lower portion of wheel assembly 28 passes through the liquid 74, the liquid 74 enters through openings 56, 58 to fill the individual troughs 66. Holes may also be placed in the wheel assembly side plates to permit the troughs to fill faster. As wheel assembly 28 travels in the direction indicated by arrow 76 the liquid-filled troughs 66 are carried upward to a position above liquid level 72 whereupon the liquid from the individual troughs 66 pours out near the top of the wheel rotation, as indicated by arrow 74, and then falls back to the bottom of tank 20.

Liquid level 72 may be adjusted by liquid level adjusting means 22 which utilizes the pump 40 and valve means 50 and 52 to transfer liquid as desired between tank 20 and reservoir 38 and dump tank 42. The liquid level 72 may be adjusted to fill all or only a portion of the troughs 66 in the trough assemblies 61 as the lower portion of wheel 28 passes through the liquid. As liquid level 72 is increased, the individual troughs closer to axis 62 in each trough assembly 61 will be filled.

As wheel assembly 28 rotates in the direction indicated by arrow 76, the presence of liquid in the individual troughs 66 in the portion of wheel 28 emerging from liquid 74 will naturally exert a downward force due to the weight of the liquid, which results in a net torque in a clockwise direction, as indicated by arrow 80. This torque is static and independent of the rotational speed of wheel assembly 28. The magnitude of this static torque in direction 80 will be determined by the height of liquid level 72 and the number of individual troughs 66 which are filled as each trough assembly 61 passes through liquid 74. Consequently, this static torque 80 may be adjusted by varying liquid level 72. The valve handles 32 operate the liquid level adjusting means 22 and provide easy adjustment of the counterforce generated by the counterweight assembly.

As seen in FIG. 1, this torque in direction 80 will be transmitted back through axis 62 to crank mechanism 18 whereupon it provides a continuous counterforce to rotation of crank mechanism 18. As a result a counterforce may be provided to the force exerted by the limbs of a person sitting in chair 12 exercising opposing muscle groups as crank throws 18a and 18b are respectively moved toward and away from the person.

In a preferred embodiment, plates 68 form troughs 66 on only one side of radial plate 64 so that each trough assembly will only pick up liquid as the wheel assembly is rotated in one direction. This prevents water being emptied from one trough assembly from being captured in an adjacent facing trough assembly as the wheel assembly is rotated at speed. With this embodiment it is desirable to utilize a forward/reverse transmission selection in gear box 34 to enable the crank mechanism 18 to be used in both directions.

Turning to FIG. 5, the width of each trough assembly 61, i.e. the distance between the side walls of the wheel assembly, is equal to the dimension a+b indicated in the figure. The mass of liquid carried in the individual troughs 66 and, consequently, the counterforce exerted by the weight of the water therein can be adjusted by varying the dimension a, the thickness of sidewall 70, to vary the width b of individual troughs 66. The width of sidewall 70 may be the same in each trough assembly or may be different in some or all of the trough assemblies to provide a varying counter-torque as the wheel assembly is rotated. In the illustration in FIG. 3 for example, the trough volume in an individual trough assembly 61 may be varied from a position d at one peripheral side of wheel assembly 28 to another position e at the opposite peripheral side of wheel assembly 28, 180° from position d. By continuously and progressively varying the trough width b in the individual trough assemblies 66 from a maximum or minimum at position d to a minimum or maximum, respectively, at position e, the counter torque in direction 80 generated by wheel assembly 28 as it passes through a constant liquid level 72 may vary from a minimum to a maximum as the wheel assembly is rotated through one revolution. The minimum and maximum torque values may be selected to coincide with particular angular positions of crank mechanism 18 so that, for example, a predetermined maximum counterforce is generated when the crank throws 18*a*, 18*b* are vertically oriented and some predetermined minimum counterforce is generated when the crank throws 18*a* and 18*b* are horizontally oriented. This would coincide with the maximum and minimum forces which a person's arm or leg could exert on crank mechanism 18 when seated in seat 12.

The trough 66 width dimension b in trough assemblies 61 may also be chosen to provide two or more maximum and minimum counter torques as wheel assembly 28 rotates through one revolution, depending on the type of counterforce which is desired to be generated.

Two coaxially aligned wheel assemblies 24, 28 are shown in the embodiments illustrated in FIGS. 1, 2 and 4. A plurality of these wheel assemblies may be incorporated in counterforce assembly 19 to provide the capability for variable counterforce generation. Where one or both of the wheel assemblies 24, 28 contain trough assemblies having varying troughs capacities around the perpheries of the individual wheel assemblies, means may be provided to adjust the relative fixed angular orientation between the two wheel assemblies 24, 28. This provides for adjustment of the amplitude of the maximum and minimum forces generated during a single rotation of crank mechanism 18, and would also provide for adjustment of the frequency of minimum and maximum countertorques. For example, when the maximum and minimum trough volumes of the adjacent wheel assemblies are brought into phase, the amplitudes of those maximums and minimums are increases. Alternately, when these maximums and minimums are oriented out of phase, the frequency of maximum and minimum countertorque, as felt at the crank 18, is increased. This may be done by positioning the wheel assemblies 24, 26 with different adjacent trough volumes, for example, with the maximum trough volume of one wheel adjacent to the minimum trough volume of the other wheel, and vice-versa.

A spring loaded hasp assembly 26 is shown for securing wheel assemblied 24 and 28 in a fixed angular orientation at their outer peripheries. The spring loading feature of the hasp allows for positive securing of the two wheel assemblies and also prevents damage to the tank 20 which would be incurred if a wheel assembly were rotated with the hasp up. As seen in FIG. 2, only wheel assembly 28 is positively secured to axis 62 by pins 82 for rotation therewith. Wheel assembly 24 may be rotated by axis 62 only when hasp assembly 26 is secured between the two wheel assemblies as shown. If desired, the hasp assembly 26 may be detached between the wheel assemblies 24, 28 so that only the fixed wheel assembly 28 will rotate with axis 62.

If desired, more than two wheel assemblies may be utilized in the counterforce assembly 19 of the present invention. As an alternative arrangement where it is not desired to have the feature of adjustment of two wheel assemblies, only one wheel assembly may be utilized.

Thus the present invention provides an efficient exercise device wherein a selected static counterforce may be generated against body engaging crank mechanism 18. Rotation of crank mechanism 18 in either direction by the limbs of a person will provide effective exercising to opposing muscle groups and do so in a manner which provides for a constant force component regardless of the speed of rotation of the crank mechanism 18. Tank liquid adjustment means 22 provides for quick and easy adjustment of the degree of counterforce exerted by the wheel assemblies. A predetermined rate of change of resistance may be provided by adjusting the flow rate means in valves 50, 52 to provide a varying level of liquid in the tank. In addition, selection of different and progressively varying trough volumes around the circumference of the wheel assemblies allows a countertorque to be generated between a maximum and a minimum as the crank is rotated. The selection of a particular angular orientation between two or more wheel assemblies also provides for adjustment of the magnitude of the maximum and minimum forces exerted during a single rotation and also for the frequency of occurence of those maximum and minimums. These phased counterforces may be selected to correspond to the ability of the limbs turning crank 18 to generate the force, or may be selected for other purposes to exercise particular muscles.

As will be apparent to persons skilled in the art, various modifications, adaptations and variations of the foregoing specific disclosure can be made without departing from the spirit and scope of this invention.

Having thus described the invention what is claimed is:

1. An exercise device comprising:

a frame;

a rotatable axle on said frame;

body engaging means for rotating said axle; and a counterweight assembly connected to said axle for producing a static counterforce to rotation of said axle, said counterweight assembly including a tank for holding a liquid at a predetermined level, and at least one wheel drivingly connected to said axle and rotatable about a non vertical axis, said wheel having a plurality of liquid containment troughs having closed sides and bottoms spaced around said axis, said troughs being positioned to pass through said tank as said wheel is rotatably driven by said body engaging means, receive at least a portion of liquid from said tank, lift and hold said liquid at a first position said liquid above said predetermined liquid level, and discharge said received liquid at a second position above said predetermined liquid level.

2. The device of claim 1 wherein said troughs are provided with perforated side plates.

3. An exercise device comprising:

a frame;

a rotatable axle on said frame;

body engaging means for rotating said axle; and a counterweight assembly connected to said axle for producing a static counterforce to rotation of said axle, said counterweight assembly including a tank for holding a liquid at a predetermined level, means for varying said predetermined liquid level in said tank, and at least one wheel drivingly connected to said axle and rotatable about a non vertical axis, said wheel having a plurality of liquid containment troughs having closed sides and bottoms spaced around said axis, said troughs being positioned to pass through said tank as said wheel is rotatably driven by said body engaging means, receive at least a portion of liquid from said tank, lift and hold said liquid at a first position said liquid above said predetermined liquid level, and discharge said received liquid at a second position above said predetermined liquid level.

4. The device of claim 3 wherein said counterweight assembly wheel includes troughs spaced at different distances from said axis.

5. The device of claim 2 wherein said counterforce assembly wheel includes a plurality of radially extending members, each member having a plurality of said troughs at said different distances from said axis.

6. The device of claim 3 wherein said troughs are spaced uniformly around said axis.

7. The device of claim 3 wherein said troughs are adapted for receiving, carrying and discharging said liquid as said wheel is rotated in either direction.

8. The device of claim 3 wherein said counterweight assembly includes a plurality of counterforce assembly wheels.

9. The device of claim 3 wherein said counterforce assembly wheel troughs spaced around said axis have progressively different liquid-carrying volumes to vary the static counterforce from a minimum to a maximum as said wheel is rotated one revolution.

10. The device of claim 9 wherein said different volumes of said troughs progressively vary from a maximum at one side of said wheel to a minimum at the opposite side of said wheel.

11. The device of claim 10 wherein said counterweight assembly includes first and second counterforce assembly wheels coaxially positioned with different adjacent trough volumes.

12. The device of claim 11 wherein said maximum trough volume of said first wheel is adjacent to said minimum trough volume of said second wheel.

13. The device of claim 11 including means for fixing said wheels in a desired angular orientation therebetween.

14. The device of claim 3 wherein said body-engaging means is a single action crank.

15. The device of claim 3 wherein said body engaging means is a double action crank.

16. The device of claim 3 wherein said troughs discharge said received liquid near the top of the rotation of said counterweight assembly wheel.

17. The device of claim 3 wherein said troughs are adapted for receiving, carrying and discharging said liquid as said wheel is rotated in one direction only.

18. The device of claim 17 including transmission means for reversing relative rotation between said body-engaging means and said counterweight assembly.

19. The device of claim 3 wherein said troughs are provided with perforated side plates.

* * * * *